US005626501A

United States Patent [19]

He

[11] Patent Number: 5,626,501

[45] Date of Patent: May 6, 1997

[54] PONTOON WATER BIKE

[76] Inventor: Xiaohai He, 4013 Brookway Dr., Fort Worth, Tex. 76123

[21] Appl. No.: 598,613

[22] Filed: Feb. 12, 1996

[51] Int. Cl.[6] ..... B63H 16/20

[52] U.S. Cl. ..... 440/30; 114/283

[58] Field of Search ..... 440/21, 26, 27, 440/28, 29, 30, 31; 114/283

[56] References Cited

U.S. PATENT DOCUMENTS

| | | | |
|---|---|---|---|
| 428,213 | 5/1890 | Jarrell | 440/90 |
| 602,072 | 4/1898 | Grady et al. | 440/31 |
| 2,674,971 | 4/1954 | Therrien | 440/30 |
| 4,559,892 | 12/1985 | Cascallana | 114/270 |
| 5,308,268 | 5/1994 | Schmid | 440/30 |
| 5,316,508 | 5/1994 | Landucci | 440/30 |

*Primary Examiner*—Jesus D. Sotelo
*Attorney, Agent, or Firm*—Guy V. Manning

[57] ABSTRACT

A pontoon water bike raft comprises two rear pontoons disposed parallel one another on either side of a longitudinal axis, with a transverse, planar truss spanning between them. Coupled by quick release joints to the midpoint of the truss and extending forward to rest on a third, front pontoon, a vertical frame supports a swivel seat for a driver. The frame includes a steering column similar to that of a conventional bicycle, allowing steering the water bike by turning the front pontoon. The steering column is tilted rearward slightly, and rests on the front pontoon rearward of its longitudinal center, to provide positive steering return when released. To propel the water bike, the driver manipulates a foot pedal mounted near the steering column and coupled by a chain to a transverse axle beneath the seat. Coupled to the axle are a plurality of planar water paddles arranged around a hub. The water bike quickly can be disassembled by uncoupling the frame and truss from the pontoons and from each other, and removing the seat from the frame and the paddle wheels from the axle.

18 Claims, 9 Drawing Sheets

PONTOON WATER BIKE

BACKGROUND OF THE INVENTION

1. Field of the Invention

This invention relates to improvements to small, human powered water craft, and particularly to one man pontoon rafts propelled by pedal-driven paddle wheels.

2. Description of Related Art

Small water craft used primarily for recreational fishing include two major types. These include dugouts, such as canoes and pirogues, which have high gunnels partially enclosing cargo or passengers located near the water line, and rafts, such as catamarans, where flotation devices such as pontoons support a superstructure above water on which ride both cargo and means for locomotion.

Various rafts in the prior art employ two parallel pontoons between which a deck spans to support one or more upright seats for fishermen. Means of propulsion may include electrically or manually driven propellers below the water line. Steering may include means for directing the propeller, or it may comprise a rudder system. Such systems often require complex transmission systems to transform axial rotation in one direction to another direction for driving the propeller. Others using electrical or gasoline motors are correspondingly heavier and more costly and require that finite quantities of fuel or batteries be carried on board. A need exists for an inexpensive, light weight raft easily propelled and steered by human effort.

Small fishing rafts usually occupy space amounting to several multiples of the cargo the raft can carry. This is due often to the spread base and vertical superstructure so common for such watercraft which often is larger than the bed of a typical pickup truck. Handling such bulky and voluminous rafts requires either a trailer or means for disassembling the craft for transportation and storage. Complexity of assembly often discourages routine disassembly to users. A need exists for a light watercraft which easily can be disassembled for transportation and storage.

SUMMARY OF THE INVENTION

Accordingly, it is an object of this invention to provide a light-weight water raft which easily and quickly can be assembled for use and disassembled for transportation and storage.

It is another object of this invention to provide a small water raft which is inexpensive to acquire and maintain.

It is another object of this invention to provide a water raft relying upon one of its pontoons for stabilized steering.

It is yet another object of this invention to provide a water raft which easily can be propelled by human effort.

The foregoing and other objects of this invention are achieved by providing a water bike raft comprising two rear pontoons disposed parallel one another on either side of a longitudinal axis, a transverse, planar truss spanning between them. Coupled by quick release means to the midpoint of the truss and extending forward to rest on a third, front pontoon, a vertical frame supports a swivel seat for a driver. The frame includes a tilted steering column similar to that of a conventional bicycle, allowing steering the water bike by turning the front pontoon. To propel the water bike, the driver manipulates a foot pedal mounted near the steering column and coupled by a chain to a transverse axle beneath the seat. Coupled to the axle are a plurality of planar water paddles arranged around a hub. The water bike quickly can be disassembled by uncoupling the frame from the truss and from the front pontoon, uncoupling the rear pontoons from the truss, and removing the paddle wheels from the axle.

BRIEF DESCRIPTION OF THE DRAWINGS

The novel features believed characteristic of the present invention are set forth in the appended claims. The invention itself, however, as well as a preferred mode of use and further objects and advantages thereof, will best be understood by reference to the following derailed description of an illustrative embodiment when read in conjunction with the accompanying drawings, wherein:

DETAILED DESCRIPTION OF A PREFERRED EMBODIMENT

Figure 1:
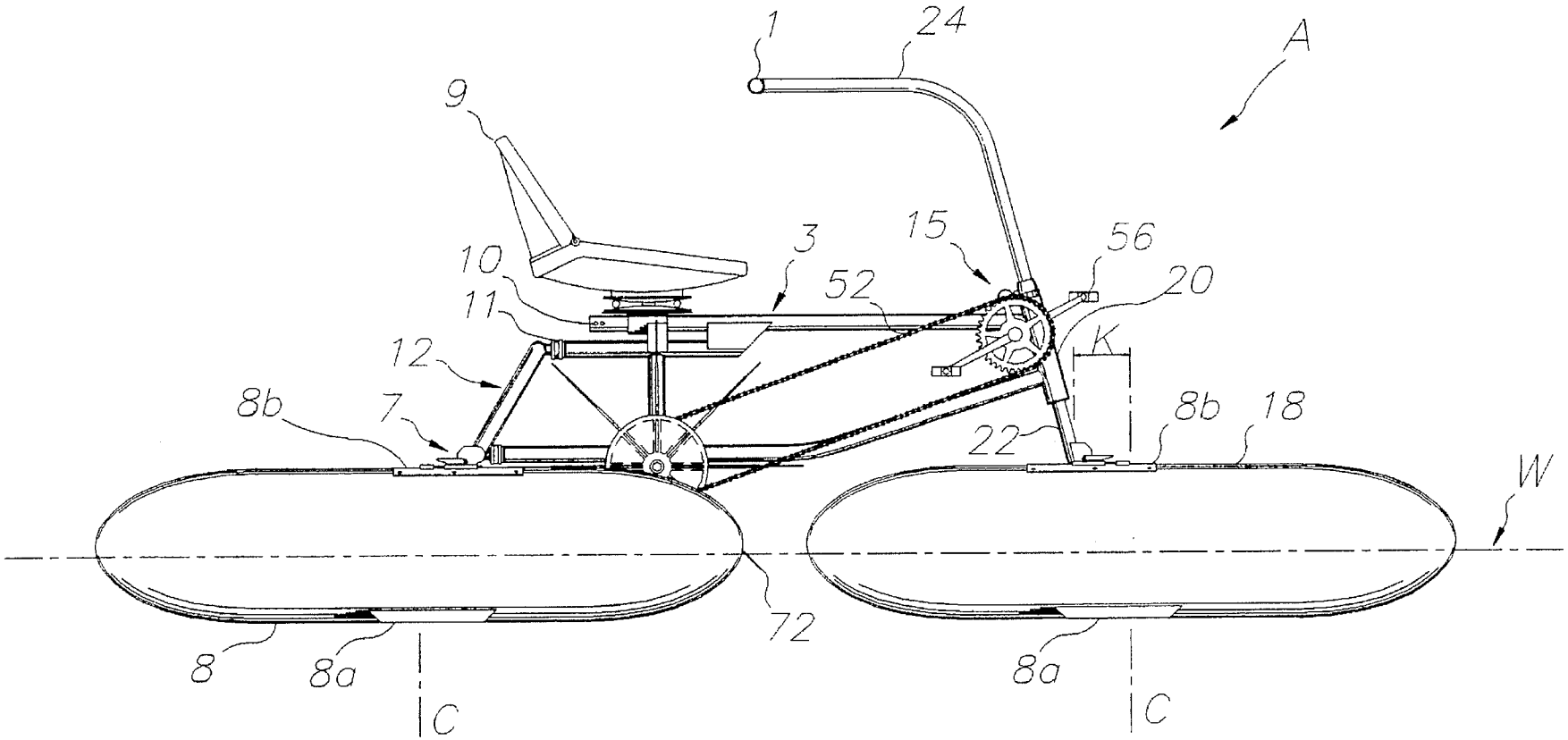
FIGS. 1 & 3 depict side and front elevational views respectively.

With reference now to the figures, and in particular to FIGS. 1–3, water bike A includes three generally cylindrical pontoons 8, 18 bearing fins 8*a* on their bottom sides and mounting plates 8*b* on their top sides, the pontoons 8, 18 shown floating level and partially submerged below water surface W. Rear pontoons 8 are disposed parallel one another on opposite sides of and equidistant from longitudinal axis L, while third, front pontoon 18 is positioned forward of rear pontoons 8 and centered on axis L. Spanning between rear pontoons 8, truss means 12 couples to pontoons 8, 18 at mounting plates 8*b* and forms a support frame fixing rear pontoons 8 in position.

Coupled to truss 12 substantially at axis L, vertical frame 3 extends horizontally forward along axis L to terminate in steering housing 20 positioned above front pontoon 18 and tilted slightly rearwardly. Steering shaft 22 rotates within housing 20 and extends downwardly therefrom to couple to front pontoon 18 at mounting plate 8*b*. Handle 24 extends upwardly from housing 20 opposite shaft 22 and then angles rearwardly toward seat 9, mounted atop frame member 3*d*. Handle 24 terminates in T-grip 1 disposed conveniently in front of a driver D (not shown) seated in seat 9. The rearward tilt of housing 20 minimizes the necessary length of handle 24, thereby also minimizing weight and cost.

Figure 10:
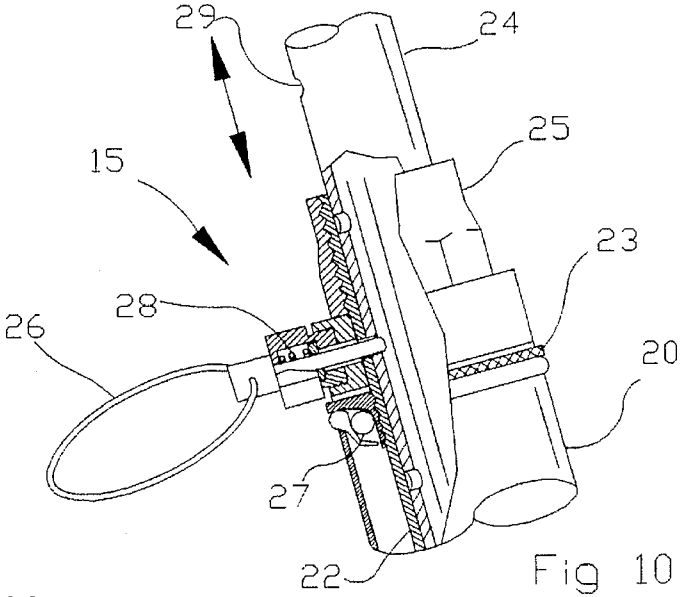
FIG. 10 details a steering mechanism coupler of FIG. 4.

As detailed in FIG. 10, steering handle 24 couples to shaft 22 within housing 20 similarly to the way some bicycle handlebars couple to their front wheel. Handle 24 and steering shaft 22 are tightly coupled together by nut 25 and extend through knurled collar 23 to rest on bearing 27 in the upper end of housing 20. Thus, handle 24 and steering shaft 22 are free to rotate within housing 20 while being locked firmly together. FIG. 10 also illustrates ring pin 26 mating with apertures 29 and biased into place by spring 28. Ring pin 26 and apertures 29 permit vertical adjustment of handle 24 and T-grip 1 for the comfort and convenience of driver D. Handle 24 also may be removed altogether in this fashion when water bike A is disassembled for transportation or storage.

Pontoons 8, 18 are interchangeable (the different reference numerals serving herein merely for convenience in distinguishing front and rear pontoons), symmetrical about transverse axis C, and streamlined in shape for efficient movement through water. Pontoons 8, 18 preferably are hollow, air tight cylinders formed from extruded or molded plastic, such as rigid, cross linked polyethylene, known for light weight and strength. One having ordinary skill in the art will recognize that other materials could be substituted, such as aluminum or steel, with consequences of added weight and cost. Further, other pontoon systems, such as styrofoam floats, could be employed without departing from the spirit and scope of the present invention. Mounting plates **8*b* on pontoons 8, 18 are offset a select distance K from centerlines C toward seat 9 so that pontoons 8, 18 do not support the weight of frame 3** at centerlines C.

Figure 2:
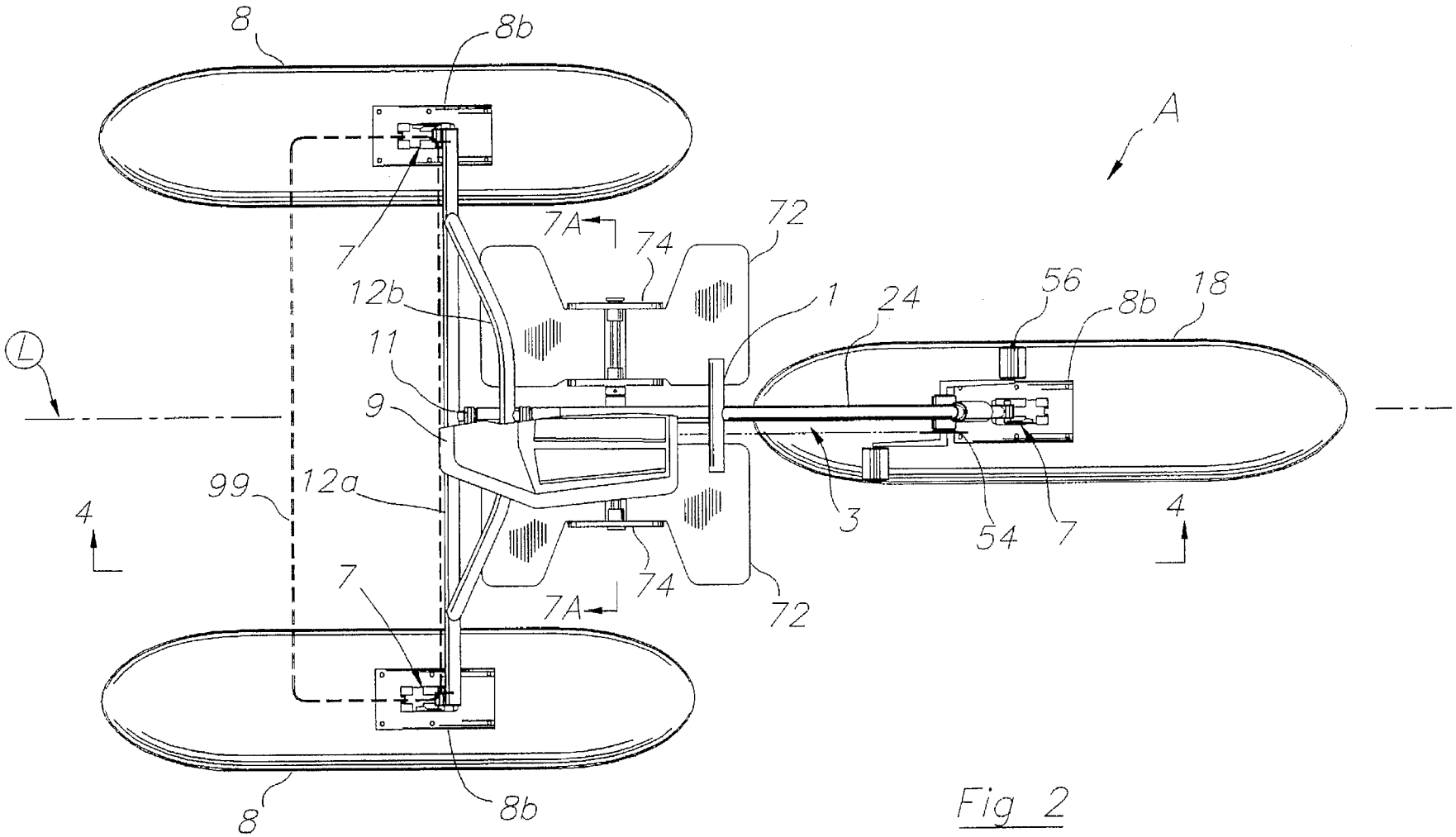
FIG. 2 depicts a plan view, of a preferred embodiment of the water bike having cylindrical pontoons.
Figure 3:
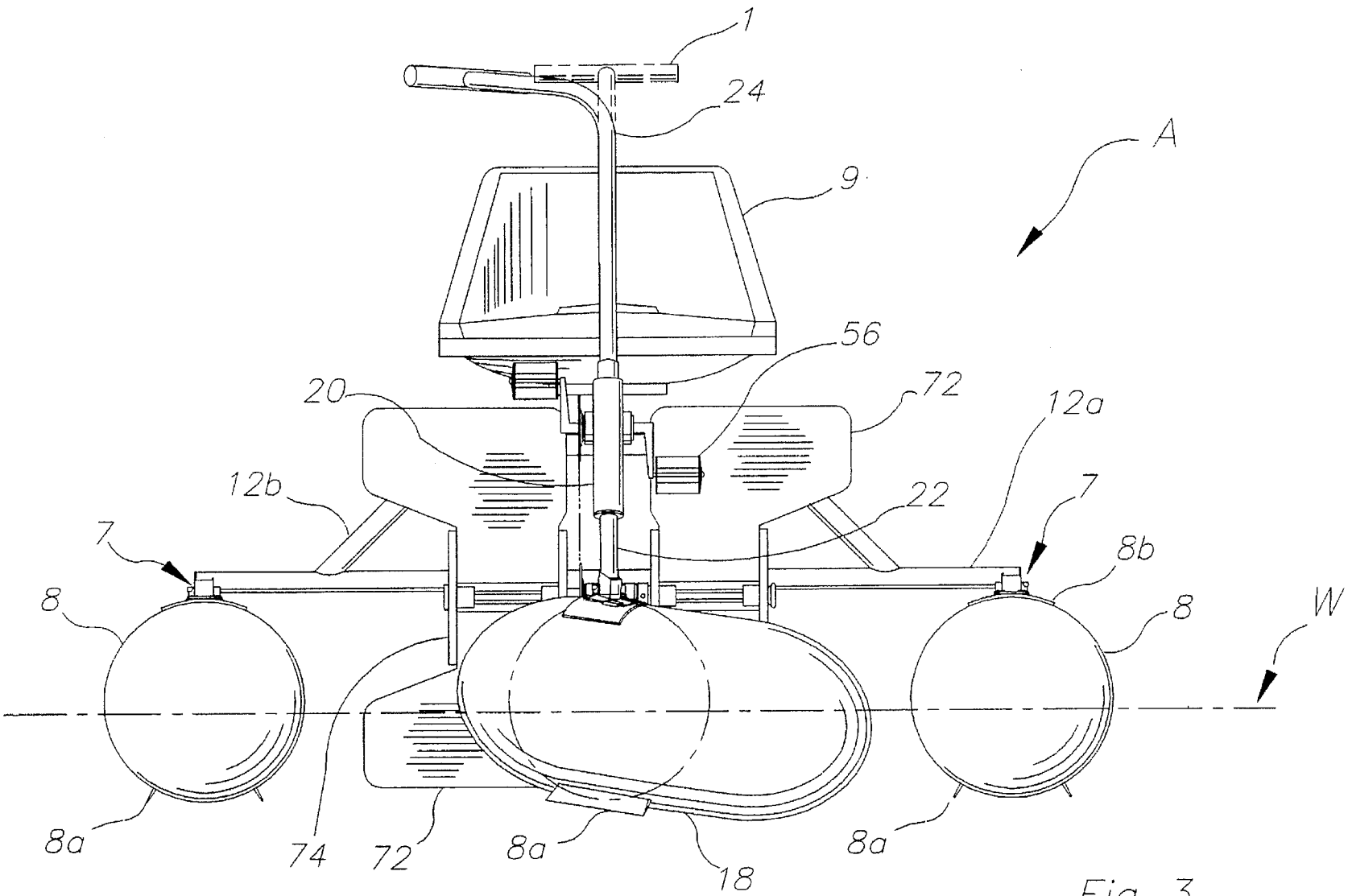

Driver D steers water bike A by moving T-grip 1 transversely to axis L, causing front pontoon 18 to become re-positioned non-parallel to axis L, as shown in FIG. 3. Thus, pontoon 18 serves as a rudder for water bike A. Further, offset K creates a novel means of stabilizing the steering of water bike A similar to the positive steering effect of power steering in automobiles. As mounted for straight running parallel axis L, front pontoon 18 is substantially level in water W (FIGS. 1 & 2 and phantom in FIG. 3). When driver D turns front pontoon 18 out of alignment with axis L either left or right, offset K and the tilt of housing 20 cause the forward end of front pontoon 18 to be forced deeper into the water than the rearward end thereof (FIG. 3). Because pontoon 18 is buoyant, this front-to-back differential is unstable, and pontoon 18 naturally rights itself and realigns with axis L when driver D releases T-grip 1. Thus, the most stable position of front pontoon 18 is parallel to axis L, resulting in a positive steering effect. This effect occurs whether water bike A is moving or not, and whether or not it is moving forward or backward.

FIGS. 5A, 5B and 6A, 6B detail quick release locks 7 which couple water bike A to pontoons 8, 18. Mounting plates **8*b* preferably are steel and curved to match the upper surface of pontoons 8, 18, and are attached thereto by screws, rivets or other suitable means. Shoe 8*c* protrudes upwardly from the center of plate 8*b* to form a recess beneath 8*c* in which is received foot 7*a* of quick release lock 7. Shoe 8*c* includes stop 8*d* against which abuts ankle 7*b* of lock 7. Cam lock 7*c* bears against shoe 8*c* to affix lock 7 in place. In this position, toe end 7*d* of foot 7*a* mates with reinforcing shoe 8*e* made in similar fashion to shoe 8*c*, and provides resistance against overturning moment from lock 7. One having ordinary skill in the art will recognize that reinforcing shoe 8*e* could be made integral with shoe 8*c*** or omitted altogether, as appropriate for strength and weight considerations.

Figure 4:
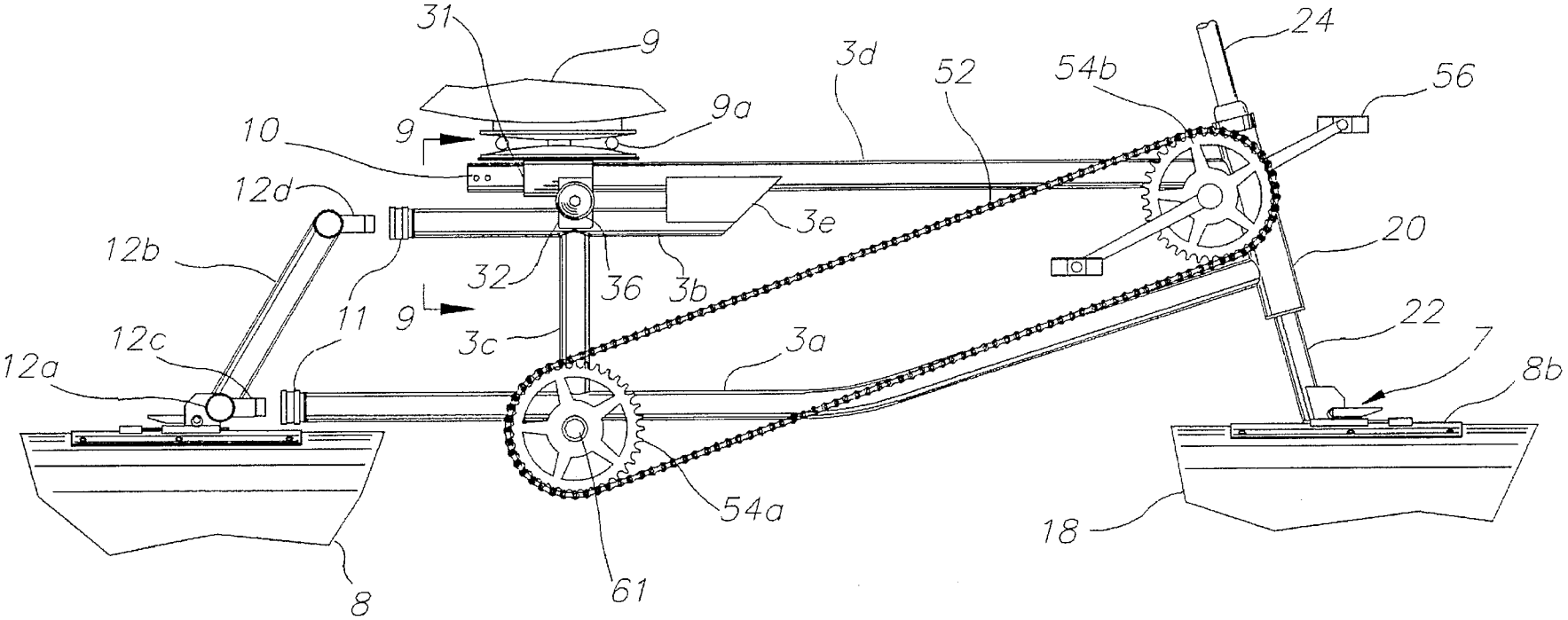
FIG. 4 shows a partial side elevation similar to FIG. 1 derailing the water bike frame and pedal assemblies.
Figure 6A:
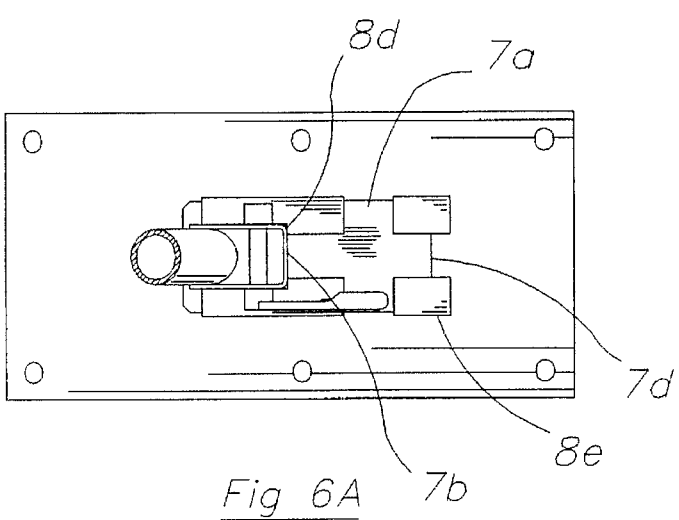
FIGS. 6A & 6B show the lock inserted into the mounting plate and locked.
Figure 6B:
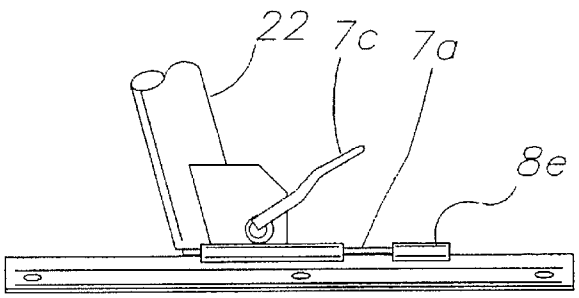
Figure 5A:
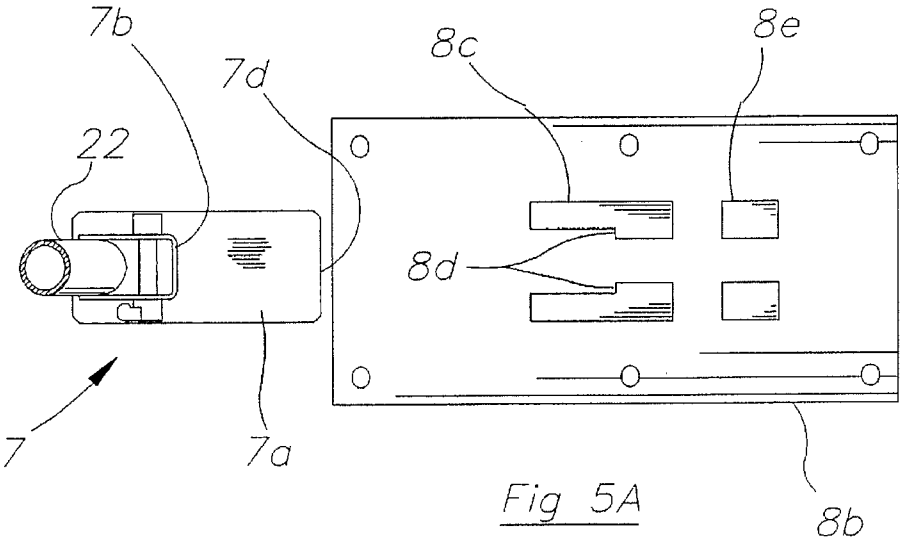
FIG. 5A & 5B detail in plan and side elevational views respectively the mounting plate on the pontoons, with the quick release lock shown poised for insertion therein. Corresponding
Figure 5B:
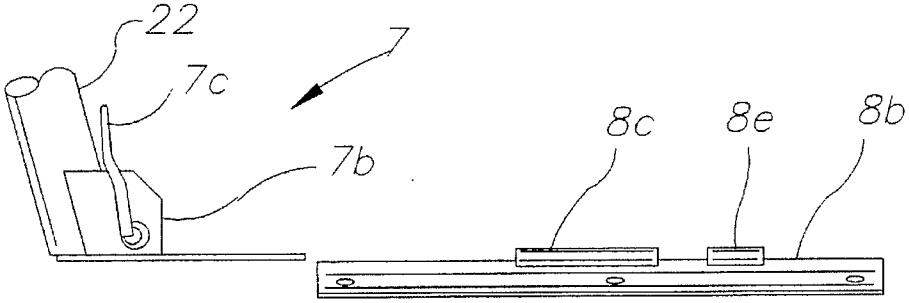

Turning now to FIGS. 1, 2 and FIG. 4, truss 12 further comprises horizontal truss member **12*a* spanning between pontoons 8. Coupled to horizontal truss member 12*a*, arched truss member 12*b* extends upwardly and tilts forwardly toward front pontoon 18. Truss extension members 12*c*, 12*d* extend forward along axis L from truss members 12*a*, 12*b* respectively to couple to frame 3 by quick release joints 11 mounted to the ends of upper and lower frame members 3*b*, 3*a*** and discussed in detail below.

Frame 3 comprises two tubular frame portions disposed vertically one above the other and extending forward from truss 12 along axis L and tied together approximately beneath seat 9 by tie member **3*c*. Neither of these upper and lower frame portions are straight their entire length. Lower frame member 3*a* extends approximately half way to front pontoon 18 and then angles upwardly to steering shaft housing 20. Disposed above lower frame member 3*a*, forward frame member 3*d* extends rearwardly from housing 20 to couple to upper rear frame member 3*b* through offset bracket 3*e* forward of tie member 3*c*. Forward frame member 3*d* continues rearwardly above upper rear frame member 3*b* and beneath seat 20**.

Frame 3 and truss 12 preferably are made from painted, circular steel tubing having a diameter of one and one-quarter (1¼") inches and sixteen gauge (16 ga.) wall thickness, or other tubing which offers the equivalent balance of lightness, strength and durability at an inexpensive price. Steel tubing also can be welded to eliminate a need for couplings to join tubular members. One having ordinary skill in the art will recognize that other tubular materials, such as aluminum, carbon or plastic piping, could be substituted without departing from the spirit and scope of this invention.

Figure 9:
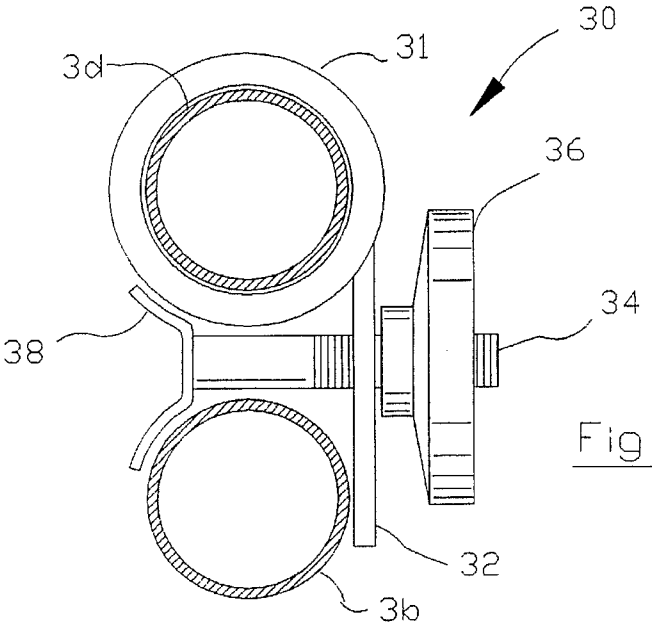
FIG. 9 derails a seat adjustment mechanism in partial cross section as indicated in FIG. 4.

Seat 9, having base **9*a*, both of conventional design, mounts atop forward frame member 3*d* rearward of offset bracket 3*e* by a unique adjustable locking mount 30 detailed in FIG. 9. Seat base 9*a* preferably swivels for convenience in getting on and off of water bike A. Seat 9 swiveled to face rearward permits driver D to step directly off the rear of water bike A without having to negotiate stepping on or over rear pontoons 8 or paddle wheel assembly 60. This mounting approach also keeps driver D's weight substantially symmetric about axis L during mounting and dismounting, and the weight of frame 3 and front pontoon 18** offset driver D's weight which otherwise would tend to tip water bike A rearwardly.

Seat mount 30 comprises cylinder 31 to which base **9*a* of seat 9 is affixed. Cylinder 31 has an inside diameter slightly larger than the outside diameter of forward frame member 3*d*, allowing cylinder 31 to slide along the length of frame member 3*d* between offset bracket 3*e* and latch end 10. Plate 32 welded to cylinder 31 extends downward along side upper rear frame member 3*b*, where clamp means secures it by friction against member 3*b*. Specifically, bolt 34 carries head 38 adapted to bear against member 3*b* and cylinder 31 when knob 36 draws it through an aperture in plate 32. Knob 36 quickly can be unscrewed to release mount 30, allowing seat 9 to be adjusted forward or backward along member 3*d*. Latch end 10 includes suitable latch means, such as retractable spring pins which protrude through forward member 3*d* (not shown), to prevent mount 30 from inadvertently sliding off the end of member 3*d* during seat positioning. One having ordinary skill in the art will recognize that other clamping means or attachment means could be employed to affix seat 9 to frame 3** without departing from the spirit and scope of the present invention.

Figure 8B:
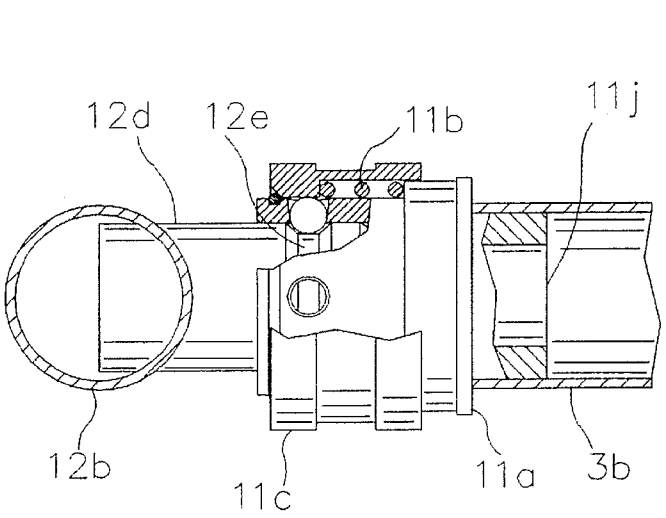
FIGS. 8A, 8B & 8C detail quick release joints coupling front and rear portions of the frame shown in FIG. 4.
Figure 8C:
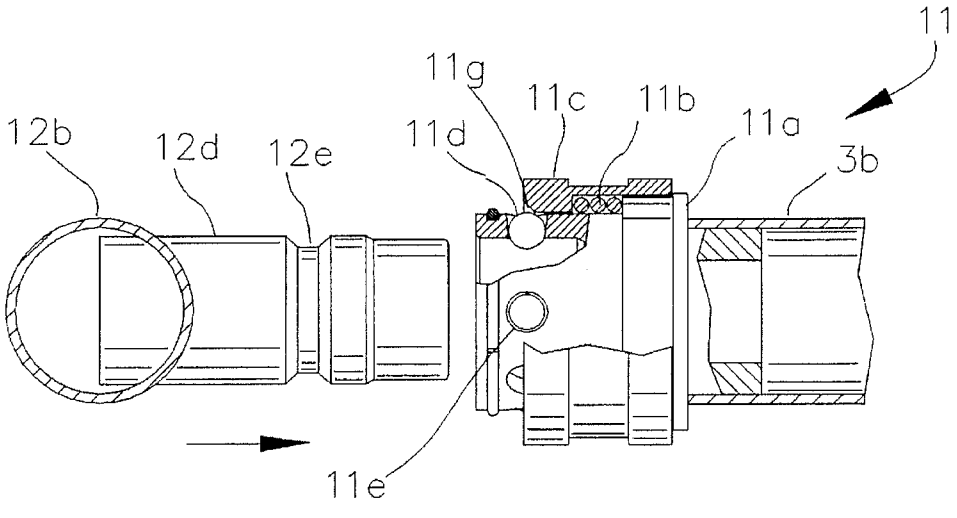
Figure 8A:
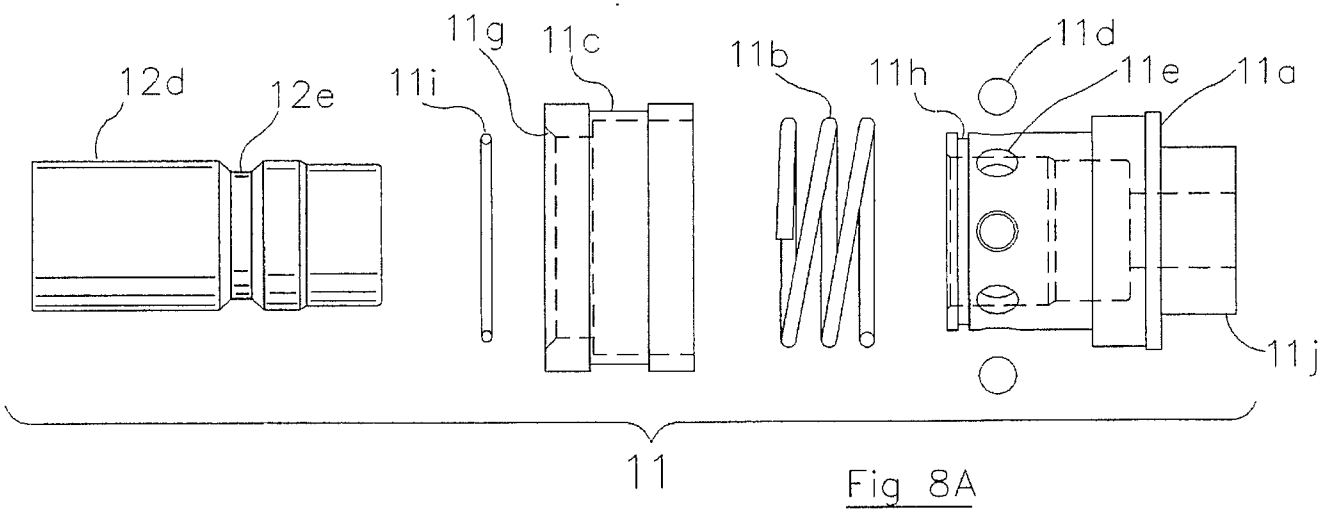

FIGS. 8A–8C detail quick release joints 11 which provide a quick and easy means of separating frame 3 and truss 12 for transportation and storage. FIG. 8A shows in longitudinally exploded view the various components of joint 11. Inner collars **11*a* are mounted to the ends of frame members 3*a*, 3*b* by forward protrusions 11*j* and include a plurality of radially disposed, conically tapered apertures lie adapted to receive and limit radial movement of spherical bearings 11*d*. Outer collar 11*c* surrounds inner collar 11*a* and bearings 11*d*, and concentric spring 11*b* biases outer collar 11*c* rearwardly over the top of bearings 11***d*, as shown in FIG. 8B. Annular groove 11*h* in inner collar 11*a* receives retainer ring 11*i* to prevent outer collar 11*c* from being forced off of inner collar 11*a* by spring 11*b*.

Outer collar 11*c* extends fully over bearings 11*d* when spring 11*b* is fully extended (FIG. 8B), thereby seating bearings 11*d* at their radial inner limit within apertures 11*e*. In this position, bearings 11*d* extend radially inward enough to reduce the inside diameter of inner collar 11*a*. Bearings 11*d* mate with groove 12*e* on truss extensions 12*c*, 12*d*, thereby coupling frame 3 to truss 12. Moving outer collar 11*a* forwardly and compressing spring 11*b* (FIG. 8C) positions the rearward end of outer collar 11*a* over bearings 11*d*, allowing them to be forced radially outward into recess 11*g* enough to extract extension 12*c*, 12*d* from within inner collar 11*a*, thereby decoupling truss 12 from frame 3.

Various other quick release joints could serve in lieu of joints 11 as frame quick release means. For example, simple pin and aperture joints coupling frame members 3*a*, 3*b* to extensions 12*c*, 12*d* could be configured similarly to ring pin means 15 shown in FIG. 10. Also, both joints 11 are not necessary. One could be replaced with a simpler, open ball-and-socket joint which would allow truss 12 to pivot relative to frame 3 when the remaining joint 11 is disengaged. Also, an internal biasing spring (not shown) could be included within quick release joint 11 to pop out truss extensions 12*c*, 12*d* when outer collar 11*c* is moved forward. Either arrangement would ease assembly and disengagement because operating two joints 11 simultaneously can be awkward for one person acting alone.

With reference now to FIGS. 7A–7D, water bike A's pedal driven paddle wheel propulsion system is shown. Axle means 60 comprises transverse axle 61 mounted to lower frame member 3*a* through sprocket shaft housing 62. Axle assembly 60 is coupled by sprockets 54*a*, 54*b* and chain 52 to pedals 56 (FIG. 4), similarly to a bicycle sprocket and chain mechanism. Pedals 56 are mounted by known means high on housing 20 near forward frame member 3*d* to position them nearly horizontally forward of seat 9. Such positioning of pedals 56 creates a recumbent pedaling position for driver D which is relaxing and comfortable to most drivers. Further, it allows driver D's center of gravity to be lower than if driver D were sitting upright. Sprockets 54*a*, 54*b* preferably have a one-to-one (1:1) ratio, but one having ordinary skill in the art will recognize that the ratio between sprockets 54*a*, 54*b* can provide driver D with some mechanical advantage, and that a multi-speed sprocket transmission system common to racing bicycles could be incorporated, without departing from the spirit and scope of the invention.

Figure 7A:
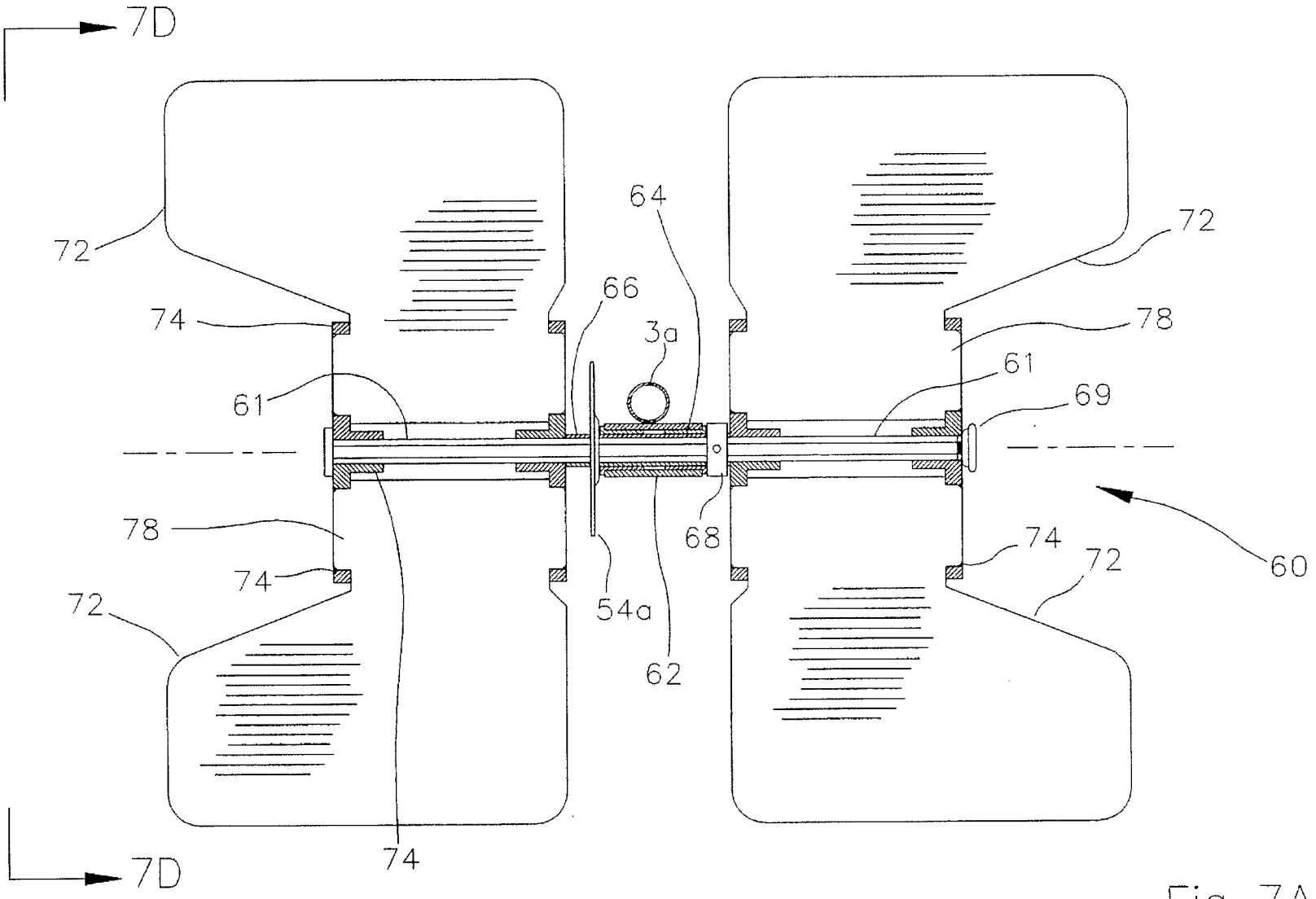
FIG. 7A through 7D detail in cross section, fragmentary section, exploded section and right side elevation, respectively, a paddle wheel assembly propulsion system of the preferred embodiment of FIG. 1.
Figure 7C:
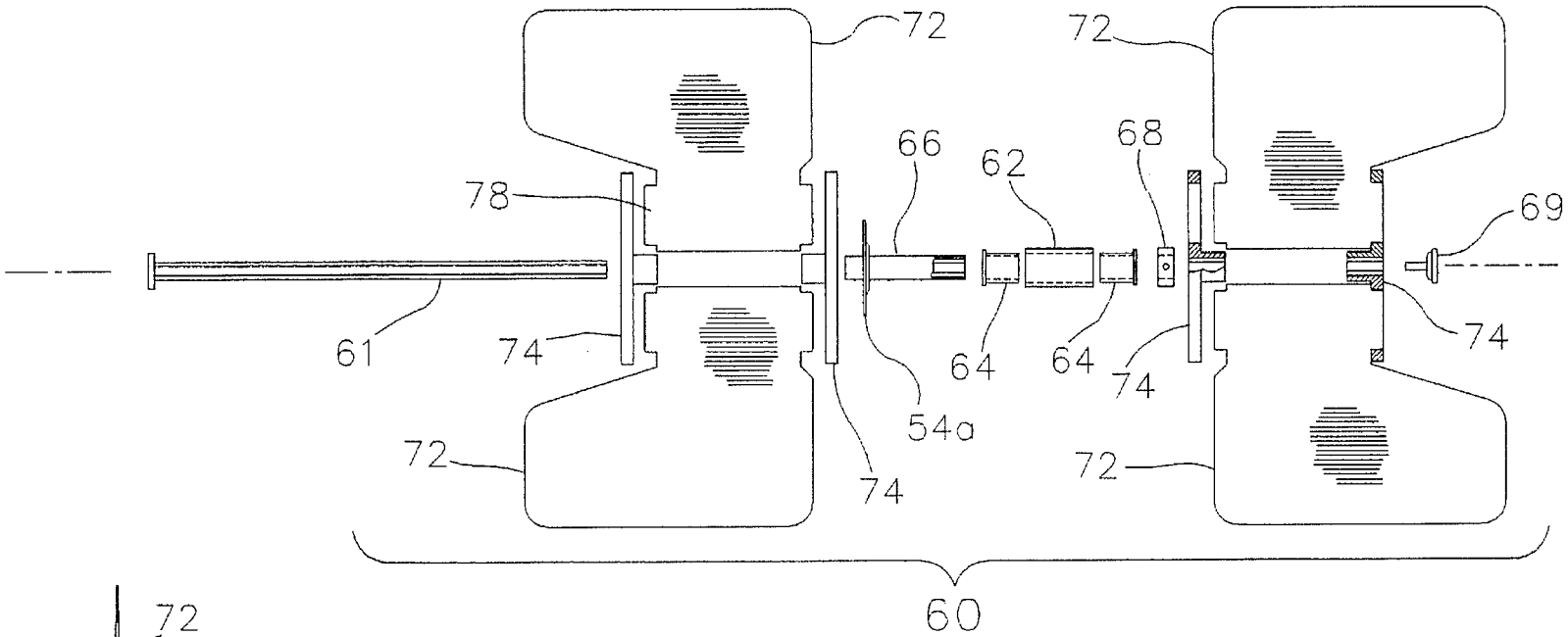
Figure 7D:
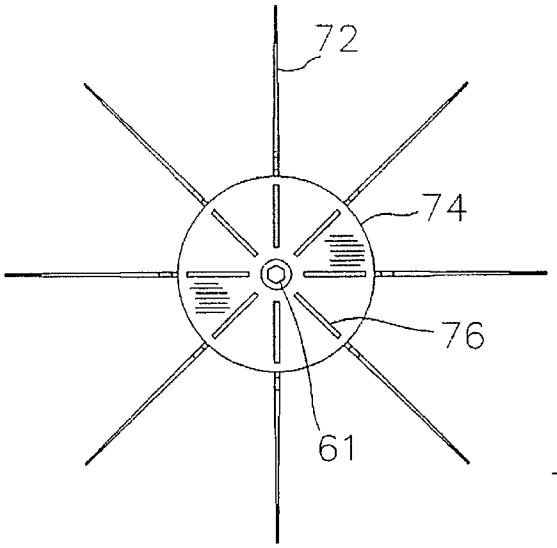
Figure 7B:
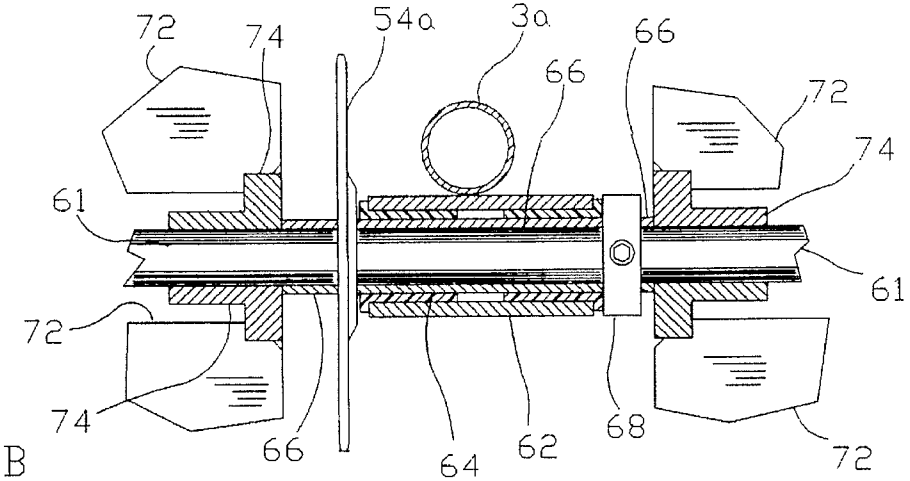

As detailed in FIG. 7B, nylon bushings 64 fit snugly into each end of sprocket shaft housing 62, and sprocket shaft 66 extends through bushings 64 and protrudes beyond both ends of shaft housing 62. Chain sprocket 54*a* mounts to one end of shaft 66, and shaft collar 68 retains shaft 66 in position. Shaft 66 comprises a cylinder having a uniform, circular outside diameter which rotates smoothly within bushings 64. The inside of shaft 66 comprises a non-circular cross section, for example hexagonal, and is adapted to receive internally axle 61 having a mating cross section. Thus, rotation of sprocket 54*b* with pedals 56 causes axle 61 to rotate with shaft 66. Suitable end fasteners 69 keep axle 61 from slipping out of place.

FIG. 7A further depicts in cross section two paddle wheel assemblies mounted onto axle 61, one on either side of shaft 66 and frame member 3*a*. A plurality of wooden, metal or plastic paddle blades 72, having narrow proximate ends adjacent axle 61 and broad distal ends, are disposed around the perimeter of axle 61 and held in place by hubs 74. Paddles 72 preferably are made of plastic, such as cross-linked polyethylene, for lightness, strength and ease of fabrication. NOTE: blades 72 appear in FIGS. 2 and 3, but various pairs thereof are omitted for clarity and simplicity. For example, in FIG. 2, horizontal blades 72 are shown, but vertical and diagonal blades are omitted. Likewise, in FIG. 3, vertical blades 72 are shown, but horizontal and diagonal blades are omitted.

Hubs 74 comprise circular disks of metal or plastic having apertures which receive internally and mate with the cross section of axle 61, thereby causing hubs 74 to rotate with axle 61. Radiating from axle 61 toward the outer circumference of hubs 74 are slots 76 adapted to receive tabs 78 disposed on the proximate ends of blades 72. When two hubs 74 are drawn together against the edge of paddle blades 72, tabs 78 lock into slots 76 and hold paddle blades 72 radial to axle 61, thereby causing them also to rotate with sprocket 54*a*. Tabs 78 and slots 76 are tapered slightly to tighten the fit between them.

Paddle blades 72 are selected to have a radial length extending downward from frame member 3*a* into the water beneath seat 9 as they rotate around axle 61 in a plane parallel to axis L. Paddles preferably are approximately ten and one-half (10½") inches long (radial length) and one foot wide at their widest point (transverse axis L). When paddle wheel assembly 60 is mounted on frame 3, blades 72 extend to within two inches of the bottom of pontoons 8, so that water bike A may be placed on the ground or other hard surface without its weight resting on blades 72. As driver D rotates pedals 56, blades 72 push water parallel to axis L, causing thrust to water bike A and moving it along axis L.

Paddle wheel assembly 60 is mounted as shown in the figures to lower frame member 3*a* just forward of frame tie member 3*c*. One having ordinary skill in the art will recognize that it could be mounted at selected other places, including on an outrigger structure (not shown) behind truss 12, in a fashion similar to paddle wheels on a river boat. Obviously, such arrangement would add to the complexity, weight and cost of water bike A, but it is within the scope and spirit of the present invention. Mounting as shown in the figures balances the weight and thrust and permits driver D to mount water bike A from the rear as discussed above.

In operation, driver D sits in seat 9, places his feet on pedals 56 and grasps handle 24 by T-grip 1. If he wishes to travel forward, he rotates pedals 56 clockwise (as viewed in FIGS. 1 and 4), thereby causing paddle blades 72 also to rotate clockwise, pushing water rearward and thrusting water bike A forward. If driver D instead wishes to travel backward, he simply rotates pedals 56 counterclockwise. Because pedals 56 may rotate in either direction, they also serve as a braking system. If water bike A is traveling forward and driver D wishes to slow or stop progress, he simply rotates pedals 56 counterclockwise to create counter thrust, thereby adjusting his speed easily and precisely.

For transportation or storage, water bike A quickly and easily may be disassembled into eight components: three pontoons 8, 18, truss 12, frame 3, seat 9, an axle assembly (axle 61, hubs 74 and a stack of paddle blades 72) and handle 24. With water bike A still floating in the water or sitting on land, the user may release end fastener 69 and extract axle 61 along its axis transverse axis L from within hubs 74 and sprocket shaft 66, as shown in FIG. 7C. Hubs 74 then release paddle blades 72, which may be stacked compactly, and hubs 74 and axle 61 laid aside. Sprocket 54*a* remains attached to frame 3 through sprocket shaft 66, thereby retaining chain 52 on frame 3 as well. The user then may loosen knob 36, release end latch 10 and slide seat 9 off the rearward end of frame member 3*d*. Next, the user may release quick release locks 7 on pontoons 8, 18 and set pontoons 8, 18 aside. Finally, the user may compress spring 11*b* with outer collar 11*a* on quick release joints 11 and decouple frame 3 from truss 12. Frame 3 and truss 12 now are substantially planar and may be stacked together to save space. Handle 26 also may be decoupled from housing 20 if desired. Chain 52 may remain on sprockets 54*a*, 54*b*, which remain attached to frame 3. Assembly for use may be accomplished by reversing the foregoing steps.

Pontoon water bike A provides a light weight, easily portable, one-man raft which is inexpensive to obtain and operate because it comprises inexpensive materials and has no complex mechanisms or motors or fuel supplies. Water bike A includes highly stable steering and disassembles easily and quickly for compact transportation and storage. When disassembled, a water bike A fits conveniently into the trunk or back seat of a conventional automobile.

When constructed of steel tubing and plastic pontoons and paddle blades, water bike A weighs approximately seventy-five (75#) pounds. When pontoons 8, 18 each are twelve (12") in diameter and four (4') feet in length (approximately 3 cubic feet of captive air volume) and made of plastic, water bike A can support a human adult of average weight (175–190 lbs) while floating in as little as six inches of water. If additional cargo capacity or carrying a substantially heavier driver is required, additional pontoons or other flotation devices may be coupled to the outboard (opposite axis L) side of rear pontoons 8 by convenient means such as non-stretch straps. Adding two more rear pontoons 8 increases by two thirds the buoyancy and load capacity of water bike A.

While the invention has been particularly shown and described with reference to a preferred embodiment, it will be understood by those skilled in the art that various changes in form and detail may be made therein without departing from the spirit and scope of the invention. For example, pontoons 8, 18 need not be identical, but could have differing shapes which might vary movement efficiency under different water conditions. Also, they could be of flexible plastic and deflatable for even more compactness during storage and transportation. Handle 24 could terminate in a single hilt (not shown) or other convenient grip rather than T-handle 1. Also, suitable storage capacity, such as saddlebags, could be mounted to truss 12, perhaps necessitating lugs thereon for stability. Truss means 12 further could comprise deck means in place of or in addition to truss member 12*a*. Said deck means (shown in one possible configuration in phantom in FIG. 2) could be planar, symmetric or asymmetric along its longitudinal dimension (parallel axis L) and could extend any convenient longitudinal length up to or even exceeding that of rear pontoons 8. Finally, other known primer mover means, such as electric or fuel driven motors mounted to frame 3 or truss 12 and coupled to sprocket shaft 62, could be provided in addition to or in lieu of human power, with obvious consequences of additional weight and cost.

I claim:

1. A pontoon water bike symmetric about a longitudinal axis and comprising a front pontoon centered on the axis;

a vertical frame coupled to the front pontoon and extending rearward along the axis and bearing a seat for a driver;

a transverse truss means coupled to the rear of the frame opposite the front pontoon;

two rear pontoons, one coupled to each end of the truss means;

a cylindrical housing coupled to the front of the frame;

a shaft received within the housing at its proximate end and coupled to the front pontoon at its distal end;

handle means coupled to the shaft and extending upward and rearward therefrom toward the seat;

positive steering means for positively aligning the front pontoon with the axis when the handle means is released by the driver; and propulsion means for propelling the water bike through water.

2. The pontoon water bike according to claim 1 wherein the positive steering means comprises a rearward tilt of the housing at its upper end; and a rearward offset of the shaft where it couples to the front pontoon relative to a transverse centerline of the front pontoon, whereby steering the front pontoon out of alignment with the axis causes differential longitudinally buoyancy thereof which causes it to return to alignment with the axis when released.

3. The pontoon water bike according to claim 1 wherein the propulsion means comprises a transverse axle assembly coupled to the frame and adapted to rotate relative thereto;

prime mover means coupled to the axle assembly; and at least one paddle assembly mounted to the axle assembly and adapted to engage the water for providing thrust to the water bike when the axle assembly rotates.

4. The pontoon water bike according to claim 3 wherein the paddle assembly comprises two hubs having axial apertures adapted to receive an axle within the axle assembly, the hubs further having a plurality of slots extending radially from the axle; and a plurality of blades having tabs on their proximate ends received within the slots and extending radially from the axle to their distal ends which engage the water.

5. The pontoon water bike according to claim 3 wherein the axle assembly comprises a sprocket shaft housing fixedly and transversely coupled to the frame, the shaft housing having a transverse axis and an inner diameter forming a first coaxial aperture;

a cylindrical sprocket shaft bearing a sprocket and adapted to rotate within the shaft housing, the sprocket shaft further having a second aperture coaxial the shaft housing;

an axle adapted to be receive within the second aperture and to rotate with the sprocket shaft.

6. The pontoon water bike according to claim 3 wherein the prime mover means comprises a first sprocket coupled to the axle assembly;

a second sprocket coupled to the frame and having pedals adapted to be operated by the driver with his feet; and a chain coupled between the first and second sprockets.

7. The pontoon water bike according to claim 1 wherein the truss means further comprises deck means for carrying cargo between the rear pontoons.

8. The pontoon water bike according to claim 1 and further comprising at least one quick release joint coupling the frame to the truss means.

9. The pontoon water bike according to claim 8 wherein the quick release joints each comprise a first inner collar coupled to the truss means and bearing an annular groove a second inner collar coupled to the frame and adapted to receive internally the first inner collar, the second inner collar having a plurality of radial holes disposed about its circumference, each of the holes having a conical shape and adapted to receive a sphere and permit the sphere to extend radially inward and engage the annular groove;

an outer collar concentric the first inner collar and adapted reciprocate longitudinally; and spring means for biasing the outer collar rearward relative to the first inner collar.

10. The pontoon water bike according to claim 1 and further comprising quick release locks coupling the front and rear pontoons to the frame and truss means.

11. The pontoon water bike according to claim 1 wherein the front and rear pontoons are of equal size and are interchangeable.

12. An improved pontoon water bike, having a vertical frame rotatably coupled to a single front pontoon and extending rearwardly along a longitudinal axis to a transverse truss having left and right ends each rigidly coupled to a rear pontoon, the frame further bearing a seat for a driver, the improvement comprising quick release joints coupling the frame to the transverse truss;

quick release locks coupling the frame to the front pontoon and the rear pontoons to the truss;

a slidable seat mount releasably coupling the seat to the frame;

a transverse axle releasably coupled to the frame;

paddle assembly means carried on said axle and adapted to engage the water for providing paddle thrust to the water bike; and sprocket drive means coupled between the transverse axle and pedals positioned on the frame in front of the seat, whereby the water bike may be quickly disassembled into component parts for storage and transportation and storage.

13. An improved pontoon water bike, having a vertical frame rotatably coupled to a single front pontoon and extending rearwardly along a longitudinal axis to a transverse truss having left and right ends each rigidly coupled to a rear pontoon, the frame further bearing a seat for a driver, the improvement comprising a cylindrical housing coupled to the front of the frame, the housing being tilted rearwardly at its upper end toward the seat;

a steering shaft having a proximate end received within the housing and a distal end coupled to the front pontoon a select distance rearward a transverse centerline of the front pontoon; and a handle coupled to the proximate end of the shaft and extending upward and rearward toward the seat;

whereby the driver's turning of the steering shaft with the handle forces the front end of the front pontoon slightly downward into the water, causing pontoon buoyancy to realign the front pontoon with the longitudinal axis when the handle is released by the driver.

14. An improved method of quickly transporting and redeploying a water craft comprising the steps of providing a pontoon water bike having a vertical frame extending along a longitudinal axis;

a driver's seat releasably coupled to the frame along the axis;

a front pontoon releasably coupled to the frame by a quick release lock;

a transverse truss releasably coupled to the frame opposite the front pontoon by a plurality of quick release joints;

two rear pontoons releasably coupled one to each end of the truss by a quick release lock;

a transverse axle releasably coupled to the frame beneath the seat, the axle carrying a paddle assembly adapted to engage the water and provide thrust to the water bike, the paddle assembly being held in place by the axle; then carrying out the disassembly steps in of a. removing the driver's seat b. releasing the transverse axle and removing the paddle assembly and the axle from the frame;

c. operating the quick release locks to decouple the pontoons from the frame and the truss; then d. operating the quick release joints to decouple the truss from the frame; then transporting the disassembled water bike to a new location; then operating steps a through d in reverse order to reassemble the water bike.

15. A pontoon water bike symmetric about a longitudinal axis and comprising a front pontoon centered on the axis;

a vertical frame coupled to the front pontoon and extending rearward along the axis and bearing a seat for a driver;

a transverse truss means coupled to the rear of the frame opposite the front pontoon;

two rear pontoons, one coupled to each end of the truss means;

steering means for steering the water bike;

positive steering means for positively aligning the front pontoon with the axis when the handle means is released by the driver; and propulsion means for propelling the water bike through water.

16. A pontoon water bike symmetric about a longitudinal axis and comprising a front pontoon centered on the axis;

a vertical frame coupled to the front pontoon and extending rearward along the axis and bearing a seat for a driver;

a transverse truss coupled to the rear of the frame opposite the front pontoon;

two rear pontoons, one coupled to each end of the truss means;

steering means for steering the water bike;

propulsion means for propelling the water bike through water; and at least one quick release means coupling the truss to the frame and having a first inner collar coupled to the truss and bearing an annular groove;

a second inner collar coupled to the frame and adapted to receive the first inner collar, the second inner collar having a plurality of radial holes disposed about its circumference, each of the holes having a conical shape and adapted to receive a sphere and permit the sphere to extend radially inward and engages the annular groove;

an outer collar concentric the first inner collar and adapted to translate longitudinally relative thereto, whereby at its rearward position the outer collar retains the spheres within the holes; and spring means for biasing the outer collar rearward relative to the first inner collar.

17. A improved pontoon water bike, having a vertical frame rotatably coupled to a single front pontoon and extending rearwardly along a longitudinal axis to a transverse truss having left and right ends each rigidly coupled to a rear pontoon, the frame further bearing a seat for a driver, the improvement comprising quick release joints coupling the frame to the transverse truss;

quick release locks coupling the frame to the front pontoon and the rear pontoons to the truss;

a slidable seat mount releasably coupling the seat to the frame;

releasable transverse axle assembly adapted to rotate relative the frame;

paddle assembly means carried on said axle assembly and adapted to engage the water for providing paddle thrust to the water bike, said paddle assembly means being easily disassembled by removal of the transverse axle; and sprocket drive means coupling the transverse axle to pedals positioned on the frame in front of the seat;

whereby the water bike may be quickly assembled for use and disassembled into component parts for transportation and storage.

18. The improved pontoon water bike of claim 17 wherein the transverse axle assembly comprises a sprocket shaft housing affixed to the frame and having a first coaxial aperature;

a sproket shaft bearing a sprocket coupled to the pedals, the sprocket shaft adapted to rotate within the shaft housing and having a second coaxial aperature; and an axle received and radially affixed to the sprocket shaft within the second coaxial aperature; and at least one removable end fastener axially retaining the axle within the second coaxial aperature, whereby the fastener may be removed for axial extraction of the axle for disassembly of the water bike.

* * * * *